US006601251B2

(12) United States Patent
Paul

(10) Patent No.: US 6,601,251 B2
(45) Date of Patent: Aug. 5, 2003

(54) HEIGHT ADJUSTABLE MEDICAL BED INCLUDING INTERMEDIATE UPPER AND LOWER STOP POSITIONS

(76) Inventor: Gerald S. Paul, 201 E. Westcott St., Liberty, IN (US) 47353

( * ) Notice: Subject to any disclaimer, the term of this patent is extended or adjusted under 35 U.S.C. 154(b) by 43 days.

(21) Appl. No.: 09/839,421

(22) Filed: Apr. 20, 2001

(65) Prior Publication Data

US 2001/0047547 A1 Dec. 6, 2001

Related U.S. Application Data

(60) Provisional application No. 60/207,883, filed on May 30, 2000.

(51) Int. Cl.[7] ..... A47B 7/00
(52) U.S. Cl. ..... 5/611
(58) Field of Search ..... 5/11, 610, 611, 5/616, 86.1; 16/35 R

(56) References Cited

U.S. PATENT DOCUMENTS

| | | | | |
|---|---|---|---|---|
| 3,373,453 A | | 3/1968 | Goodman | |
| 3,593,350 A | | 7/1971 | Knight et al. | |
| 3,802,002 A | | 4/1974 | Jonas | |
| 3,958,283 A | | 5/1976 | Adams et al. | |
| 4,097,939 A | | 7/1978 | Peck et al. | |
| 4,324,010 A | | 4/1982 | Houlbert et al. | |
| 4,472,845 A | | 9/1984 | Chivetta et al. | |
| 4,953,243 A | * | 9/1990 | Birkmann | 5/600 |
| 5,095,562 A | * | 3/1992 | Alexander | 5/611 |
| 5,317,769 A | | 6/1994 | Weismiller et al. | |
| 5,438,723 A | | 8/1995 | Carroll | |
| 5,509,159 A | | 4/1996 | Du-Bois | |
| 5,887,302 A | | 3/1999 | DiMucci et al. | |
| 6,058,531 A | | 5/2000 | Carroll | |
| 6,230,344 B1 | * | 5/2001 | Thompson et al. | 5/611 |

* cited by examiner

*Primary Examiner*—Heather Shackelford
*Assistant Examiner*—Lisa M. Saldano
(74) *Attorney, Agent, or Firm*—Stevens & Showalter LLP

(57) ABSTRACT

A medical bed including a frame supported on pivoted support members wherein pivoting of the support members results in vertical movement of a patient support surface of the bed. The pivoting of the support members is accomplished by motors which are actuated by a control circuit operating in response to operator actuated switches. The bed is movable between uppermost and lowermost positions wherein a lower intermediate position is provided adjacent to and vertically spaced from the lowermost position, and an upper intermediate position is provided adjacent to and vertically spaced from the uppermost position. The controller operates to automatically stop vertical movement of the bed when it reaches either the lower intermediate position or the upper intermediate position. In addition, one of the support members for the bed includes rollers for engaging the floor surface, and the other support member includes a frictional engaging surface for engaging the floor surface at a substantially stationary position whereby vertical movement of the bed results in horizontal movement of the patient support surface.

16 Claims, 11 Drawing Sheets

HEIGHT ADJUSTABLE MEDICAL BED INCLUDING INTERMEDIATE UPPER AND LOWER STOP POSITIONS

This application claims the benefit of U.S. Provisional Application No. 60/207,883, filed May 30, 2000.

BACKGROUND OF THE INVENTION

1. Field of the Invention

The present invention relates to adjustable beds and, more particularly, to adjustable medical beds providing a plurality of height adjustable positions.

2. Description of the Prior Art

Beds for patients/residents requiring long term care are designed to meet a variety of needs, including designs which are adapted to accommodate particular needs of patients/residents, as well as to facilitate medical procedures provided to patients/residents on the beds. One function required of such beds for long term care patients/residents includes the ability to position a patient support surface to different vertical positions relative to the floor. For example, during normal use of the bed by the patient/resident, it is desirable to have the bed located at a convenient level for the patient/resident to easily enter and exit the bed. Alternatively, it is desirable to have the patient supporting surface at an elevated position to locate the patient/resident at a convenient height when it is necessary for medical personnel to interact with the patient/resident, such as during an examination or performance of a medical procedure with the patient/resident on the bed.

Among the requirements for such height adjustable beds, is the necessity to provide for easy actuation of the bed while minimizing operator input to the bed controls. In addition, it is desirable to provide a bed which provides both convenient vertical and horizontal positioning of the patient support surface for the purpose of access by medical personnel.

U.S. Pat. No. 4,472,845 (Chivetta et al.) discloses a height adjustable hospital bed which is vertically movable from a lowered position to a raised position. This bed is shown mounted to a frame which is supported on a plurality of casters, and a movable upper frame is supported for vertical adjustment relative to the fixed frame wherein the movable frame is located above the fixed frame in the lowermost position of the bed. Accordingly, the overall height between the floor and the patient support surface for this bed must accommodate the distance required by the casters and fixed frame.

U.S. Pat. No. 5,317,769 (Wiesmiller et al.) discloses a bed similar to that of Chivetta et al. in that a height adjustable hospital bed is disclosed including a vertical bed adjustment mechanism supported on a lower base frame wherein the lower base frame is supported by a plurality of casters. In this bed also, the minimum vertical height of the patient support surface is limited by a vertical dimension including the casters and base frame, above which the height adjustment mechanism operates.

Accordingly, there is a continuing need for a long term bed which provides a wide range of vertical height adjustment for a patient support surface, and which also provides for convenient horizontal positioning of the patient support surface. In addition, there is a need for such a bed wherein the vertical height positions may be preselected in accordance with predetermined anticipated needs of a patient/resident supported on the bed.

SUMMARY OF THE INVENTION

The present invention provides a height adjustable medical bed, particularly for use with patients/residents requiring long term care. The bed includes a support surface for supporting a person in a supine position, and a main frame supporting the support surface and defining head and foot ends for the bed. The main frame is supported by support members including a head end member and a foot end member having upper ends pivotally attached to the main frame. The head end member includes a lower end supporting rollers defining roller engaging surfaces for rolling on a floor surface. The leg end member includes a lower end including a non-rolling or frictional engaging surface for engaging the floor surface in a substantially stationary position. The head end member and foot end member are each actuated by a drive means comprising a motor wherein the motors are connected to a control system whereby operator actuated switches are used to control actuation of the motors. The motors may be actuated to move the patient support surface to different horizontal and vertical positions as well as to Trendelenberg and reverse Trendelenberg positions.

A sensor is provided for a sensing the position of the frame as it is moved toward a lowermost position and for automatically terminating downward movement of the frame at a lower intermediate position adjacent to and spaced from the lowermost position. The lower intermediate position provides a preferred day position for the bed which locates the patient support surface at a convenient height for entering and exiting the bed, and the lowermost position provides a preferred night position for the bed located closely adjacent the floor.

The lower end of the foot end member is additionally provided with a roller engaging surface located adjacent to and in fixed relation to the frictional engaging surface. The roller engaging surface is adapted to move into engagement with the floor surface, and the frictional engaging surface is adapted to move out of contact with the floor surface, when the frame of the bed is moved to an uppermost position. In particular, a sensor is provided for sensing the position of the frame as it approaches the uppermost position and for signaling the control system to terminate upward movement of the frame at an upper intermediate position adjacent to and spaced from the uppermost position. The upper intermediate position corresponds to a position for locating a patient/resident on the bed at a convenient position for medical treatments and examination. In this position, the frictional engaging surface is in contact with the floor and the roller engaging surface of the foot end member is out of engagement with the floor. Subsequent upward movement of the bed results in the roller engaging surface of the foot end member moving into rolling engagement with the floor surface to facilitate horizontal rolling movement of the bed to a new location.

Therefore, it is an object of the present invention to provide a long term care medical bed capable of vertical movement and including intermediate stop positions between uppermost and lowermost patient support positions.

It is a further object of the invention to provide a vertically adjustable bed including pivoted head end and foot end support members wherein the foot end support member includes a frictional engaging surface for engaging the floor at a stationary position and the head end member includes a roller member for rolling across the floor surface.

Other objects and advantages of the invention will be apparent from the following description, the accompanying drawings and the appended claims.

DETAILED DESCRIPTION OF THE PREFERRED EMBODIMENT

Figure 1:
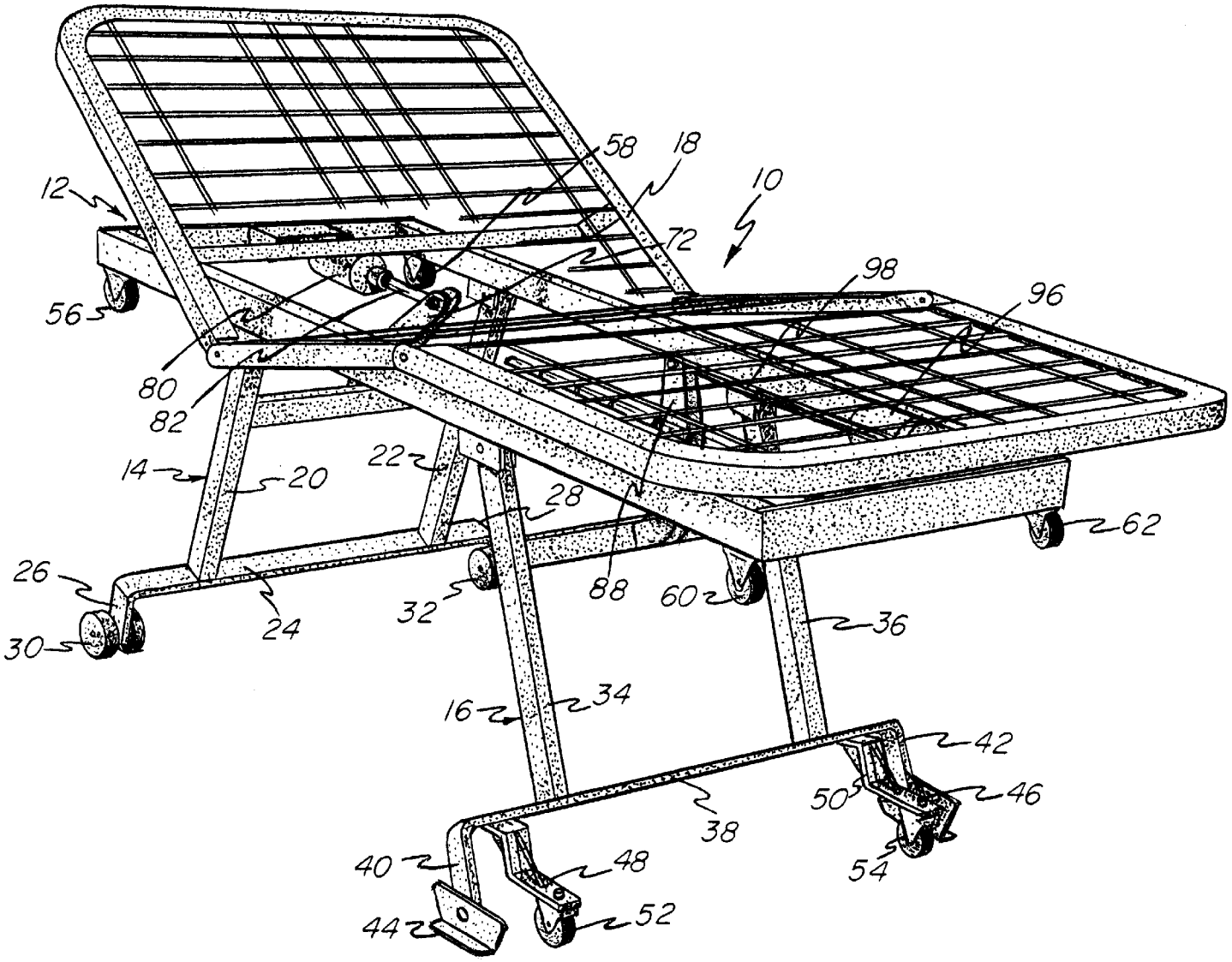
FIG. 1 is a perspective view of the medical bed of the present invention.

Referring to FIG. 1, the medical bed 10 of the present invention generally comprises a main frame 12 defining head and foot ends of the bed and supported on support members including a head end support member 14 and a foot end support member 16. The main frame 12 supports an articulated patient support surface 18 which is adapted to be actuated for movement between a flat position for supporting a patient/resident in a supine position and a plurality of articulated positions. A preferred mechanism for articulating the patient support surface 18 is described in U.S. Pat. No. 6,076,209, which patent is incorporated herein by reference.

The head end support member 14 includes a pair of upper leg portions 20, 22 having upper ends pivotally mounted to the main frame 12 and lower ends rigidly attached to a transverse support portion 24. A pair of lower leg portions 26, 28 extend downwardly from the transverse support portion 24 and are located transversely outwardly from the lower ends of the upper leg portions 20, 22. The lower ends of the lower leg portions 26, 28 include rollers or casters 30, 32 defining roller engaging surfaces for supporting the head end support member 14 in rolling engagement with a floor surface.

The foot end support member 16 includes a pair of upper leg portions 34, 36 having upper ends pivotally mounted to the main frame 12 and lower ends rigidly attached to a transverse support portion 38. A pair of lower leg portions 40, 42 extend downwardly from the transverse support portion 38 and are located transversely outwardly from the lower ends of the upper leg portions 34, 36. The lower ends of the lower leg portions 40, 42 pivotally support foot members 44, 46, respectively. The foot members 44, 46 are preferably formed as flat plate members defining friction engaging surfaces for engaging a floor surface in non-rolling contact, while permitting pivotal movement of the lower leg portions 40, 42 relative to the foot members 44, 46.

The foot end support member 16 further includes a pair of auxiliary wheel support structures 48, 50 extending longitudinally away from the head end of the bed, wherein the auxiliary wheel support structure 48 is located between the lower end of the upper leg portion 34 and the upper end of the lower leg portion 40, and the auxiliary wheel support structure 50 is located between the lower end of the upper leg portion 36 and the upper end of the lower leg portion 42. A distal end of the auxiliary wheel support structure 48 supports a caster wheel 52, and the auxiliary wheel support structure 50 includes a distal end supporting a caster wheel 54 wherein the caster wheels 52, 54 are normally out of engagement with the floor surface when the foot members 44, 46 are positioned in engagement with the floor surface.

The main frame 12 further includes a plurality of casters mounted to the underside of the main frame 12. Specifically, a pair of casters 56, 58 are mounted adjacent the head end corners of the main frame 12, and a pair of casters 60, 62 are mounted adjacent the foot end corners of the main frame 12.

Figure 2:
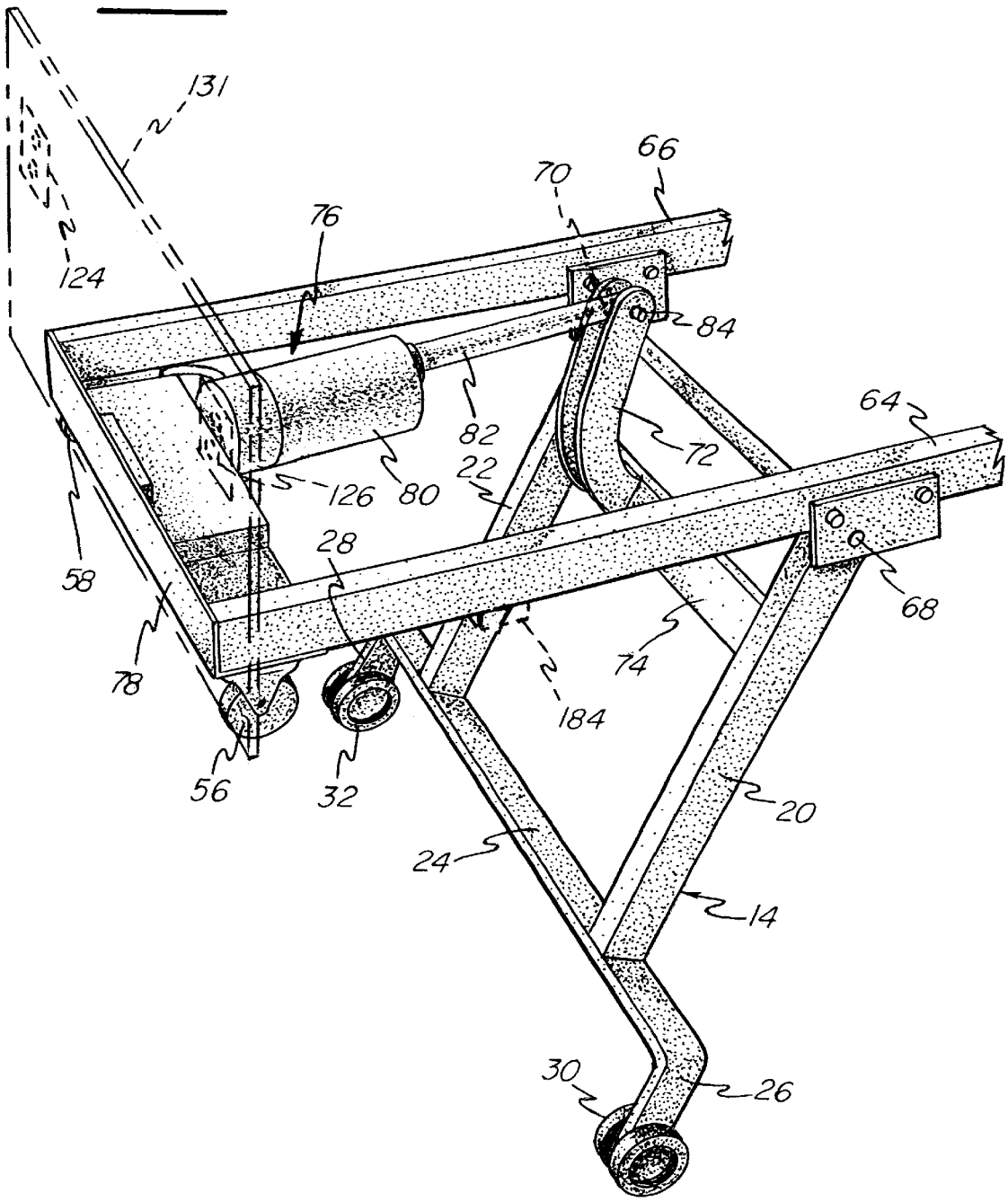
FIG. 2 is a perspective view of the head end of the bed showing the head end pivot mechanism and motor actuator.

Referring to FIG. 2, the head end support member 14 is illustrated in greater detail, and it can be seen that the upper ends of the upper leg portions 20, 22 are attached to longitudinal portions 64, 66 of the frame 12 at pivot connections 68, 70, respectively. An upwardly extending arm 72 is rigidly attached to a cross member 74 extending between the upper leg portions 20, 22, and the arm 72 is formed with a curved shape to maximize the force applied to the support member 14 about the axis defined by the pivot connections 68, 70. A first actuator 76 is mounted to a transverse portion 78 of the frame 12 and includes a first motor 80 and screw linear actuator 82 having a distal end attached to an upper end of the arm 72 at a pivot connection 84. Thus, actuation of the first motor 80 causes the screw linear actuator 82 to drive the head end support member 14 in pivotal movement relative to the frame 12.

Figure 3:
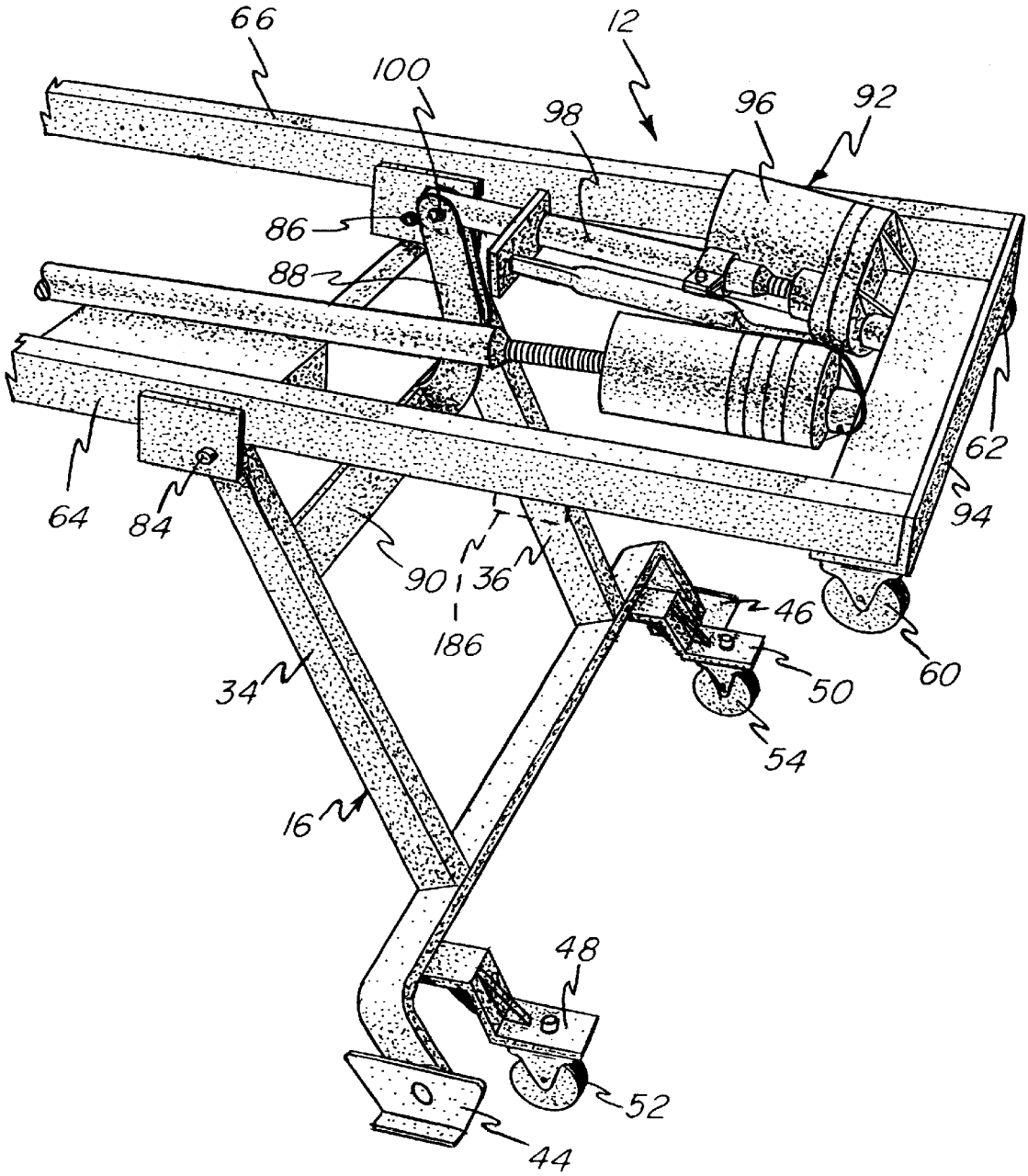
FIG. 3 is a perspective view of the foot end of the bed showing the foot end pivot mechanism and motor actuator.

Referring to FIG. 3, the upper ends of the upper leg portions 34, 36 of the foot end support member 16 are attached to the longitudinal portions 64, 66 of the main frame 12 at pivot connections 84, 86, respectively. A curved upwardly extending arm 88 is rigidly attached to a cross member 90 extending between the upper leg portions 34, 36. A second actuator 92 is supported to a transverse portion 94 of the main frame 12 and includes a second motor 96 and screw linear actuator 98. An end of the screw linear actuator 98 is attached to an upper end of the arm 88 at a pivot connection 100 whereby actuation of the second actuator 92 causes pivotal movement of the foot end support member 16.

Figure 3A:
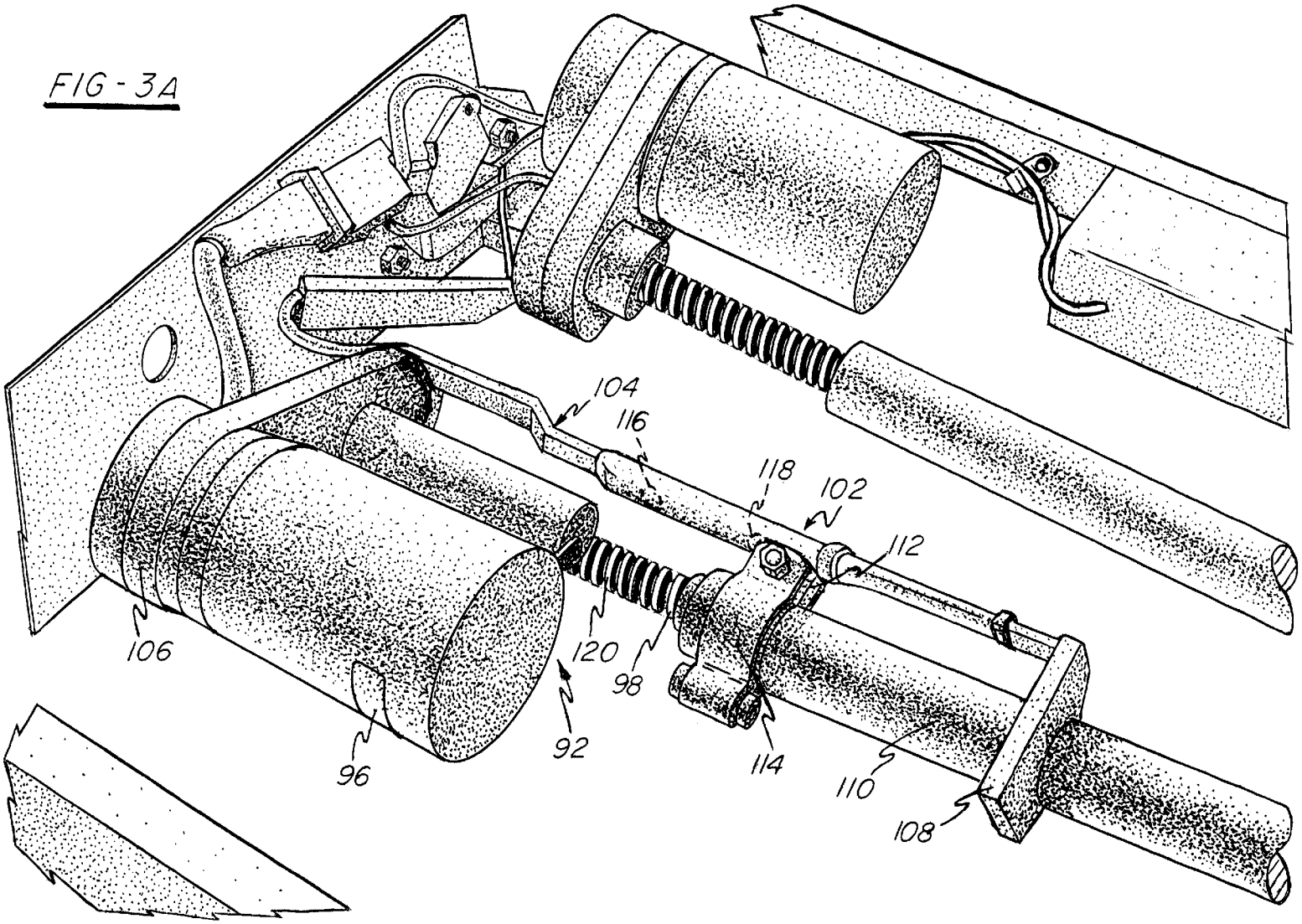
FIG. 3A is a detailed view of the motor actuator showing a sensor mechanism for sensing the vertical position of the bed.

Referring additionally to FIG. 3A, a detail view of the second actuator 92 is shown, including a sensor mechanism 102 for sensing particular predetermined positions of the screw linear actuator 98. The sensor mechanism 102 is provided for sensing intermediate positions between two extreme positions of the second actuator 92 wherein the second actuator 92 will automatically stop at the two extreme positions defining uppermost and lowermost positions for the main frame 12.

The sensor mechanism 102 comprises a support bar 104, which in the embodiment shown is attached to a gear transmission housing 106 of the second actuator 92. The bar 104 extends forwardly parallel to the screw linear actuator 98, and includes a bearing member 108 attached rigidly to a distal end of the bar 104. The bearing member 108 is supported in sliding contact over an outer screw receiving tube portion 110 of the screw linear actuator 98. A magnet 112 is clamped in a stationary position on the tube portion 110 by a clamp, such as a saddle clamp 114. A pair of Hall-effect sensors 116, 118 are supported on the bar 104, and are located such that the magnet 112 will pass in close proximity to them as the tube portion 110 is driven in linear movement relative to the screw 120 of the screw linear actuator 98. The Hall-effect sensors 116, 118 are part of a control system and are connected to a circuit portion of the control system (as is described further below) to signal the control system when the bed 10 is moved to a lower intermediate position and an upper intermediate position wherein movement of the magnet 112 to a location adjacent the Hall-effect sensor 118 corresponds to positioning of the bed 10 at the lower intermediate position, and movement of the magnet 112 to a location adjacent the Hall-effect sensor 116 corresponds to positioning of the bed 10 at the upper intermediate position. It should be noted that operation of the actuator motors 80 and 96 is controlled such that the motors 80, 96 will operate to simultaneously move the head end support member 14 and leg end support member 16 in synchronized movement to maintain the main frame 12 parallel to the floor surface as the bed 10 is moved in vertical movement between the lowermost and uppermost positions.

Figure 4:
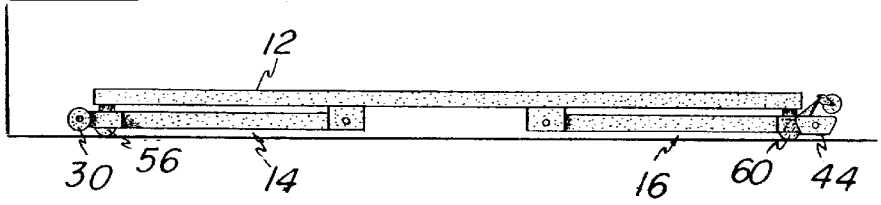
FIG. 4 is a side elevational view showing the bed in the lowermost position.

Referring to FIGS. 4–7, the four predetermined stop positions for the bed are illustrated. FIG. 4 illustrates the lowermost position for the bed in which the upper, patient supporting surface of a mattress supported by the main frame 12 is approximately 8 inches from the floor. In this position, the head end casters 30, 32 and foot end foot members 44, 46 are raised out of contact with the floor surface permitting engagement of the casters 56, 58, 60, 62 with the floor surface to facilitated rolling movement of the bed 10 across the floor surface. It should be noted that in this position, the casters 30, 32 on the head end support member 14 may serve as bumpers at the head end of the bed 10 for preventing the head end of the frame 12 from contacting walls when the bed 10 is relocated in the lowered position.

Figure 5:
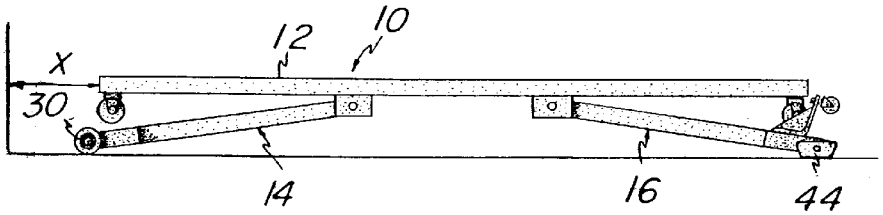
FIG. 5 is a side elevational view showing the bed in a lower intermediate position.

FIG. 5 illustrates the bed 10 in a lower intermediate position. In this position, the casters 30, 32 on the head end support member 14 are located in engagement with the floor surface, as are the foot members 44, 46 of the foot end support member 16. The position shown in FIG. 5 positions the upper, resident or patient supporting surface of a mattress supported by the main frame 12 approximately 14 inches from the floor to provide a daytime position facilitating patient/resident ambulation, such as may be required for nursing home patients/residents that can get out of bed. This position may be contrasted to that of FIG. 4 which is adapted to position a patient/resident directly adjacent a floor, providing a safe position for nighttime when there may be a danger of a patient/resident rolling out of bed. As noted previously, the lower intermediate position of FIG. 5 is defined by the magnet 112 moving into proximity to the Hall-effect sensor 116 whereby both of the motors 80, 96 will be deactivated upon reaching this position. By providing a predetermined stop position for the motors 80, 96 in movement of the bed either upwardly or downwardly to the lower intermediate position of FIG. 5, a constant reference position is provided for medical workers which results in improved patient/resident safety in that the patient/resident is consistently placed at the same daytime position, avoiding errors in placing the patient/resident at too high a position endangering the patient/resident when exiting the bed, or too low a position inconveniencing the patient/resident in needing to rise up out of the bed.

Figure 6:
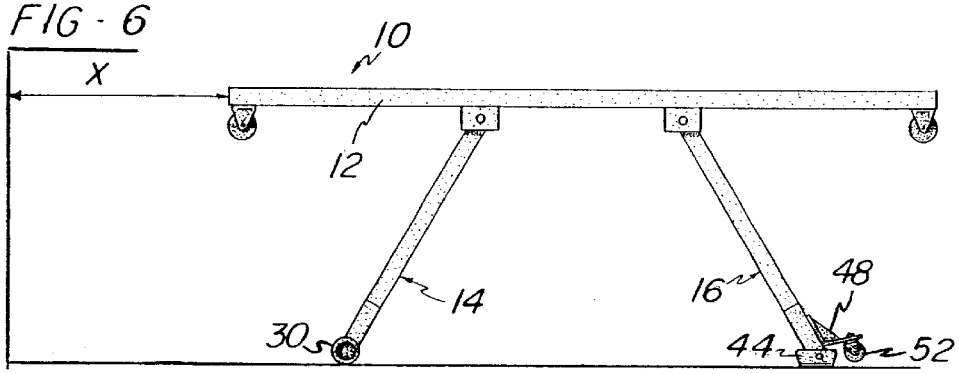
FIG. 6 is a side elevational view showing the bed in an upper intermediate position.

FIG. 6 illustrates the bed 10 at an upper intermediate position wherein the resident or patient supporting surface is located approximately 28 inches off the floor. In this position, the casters 30, 32 and foot members 44, 46 continue to support the bed, and the bed is in an elevated position to facilitate performance of examinations and/or procedures by medical personnel. It should be noted that in moving from the position of FIG. 5 to the position of FIG. 6, the foot members 44, 46 remain in a stationary position on the floor surface while the casters 30, 32 roll, resulting in the head end of the bed frame 12 moving horizontally as is illustrated by the dimension X in FIGS. 5 and 6 illustrating the dimension between the head end of the bed frame 12 and a vertical wall surface. This vertical movement of the frame 12 facilitates positioning of the bed for examination or treatment of the patient/resident, and which typically requires horizontal movement of the bed away from the wall to facilitate access to the patient/resident by medical personnel. As noted previously, the upper intermediate position is defined by the magnet 112 moving into proximity to the Hall-effect sensor 118 which condition results in both of the motors 80 and 96 being deactivated at the upper intermediate position.

Figure 7:
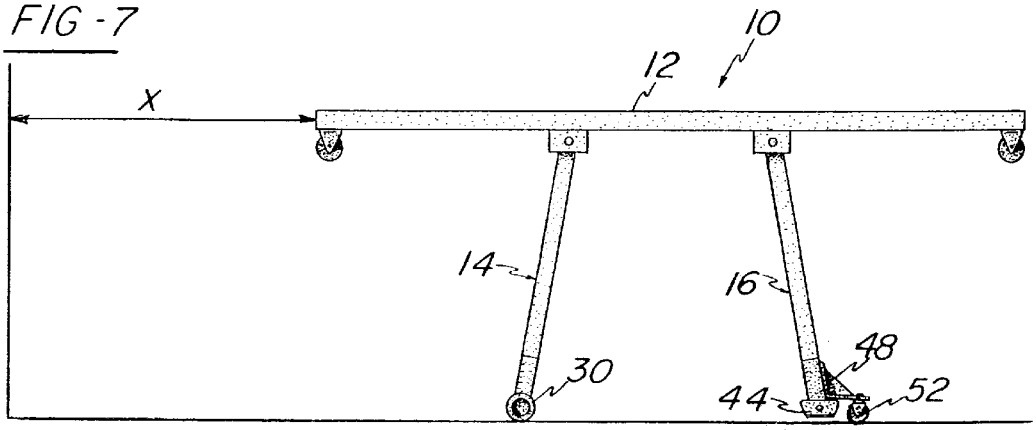
FIG. 7 is a side elevational view showing the bed in an uppermost position.

FIG. 7 illustrates the uppermost position for the bed 10 which locates the patient supporting surface approximately 31 inches from the floor, and which provides for transportation of the bed in its raised position. In particular, as the foot end support member 16 is pivoted from its position in FIG. 6 to the position in FIG. 7, the auxiliary wheels 52, 54 on the auxiliary wheel support structures 48, 50 are pivoted from a position located above and out of contact with the floor surface to a position engaged with the floor surface. In this position, the foot members 44, 46 are lifted out of engagement with the floor surface to provide for rolling movement of the bed 10 on the head end casters 30, 32 and foot end auxiliary wheels 52, 54, permitting convenient movement of the bed 10 with the frame 12 located in an elevated position.

With respect to the above-noted intermediate positions it should be noted that the location of the upper and lower intermediate positions may be altered from the heights described above by changing the location of the Hall-effect sensors 116, 118, as desired. Further, additional intermediate positions may be provided by, for example, providing additional sensors to provide more than four stop positions for locating the main frame 12.

Figure 8:
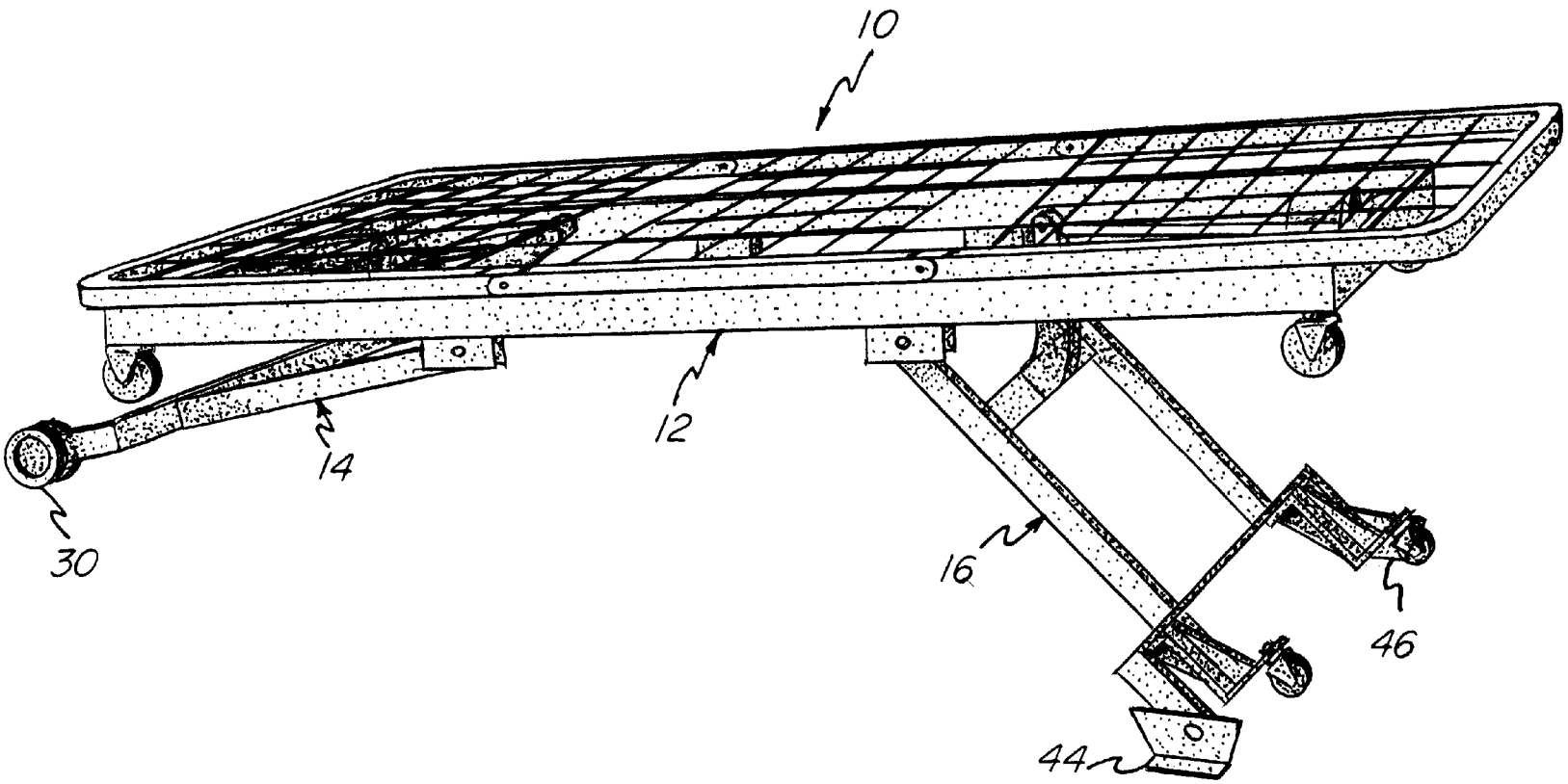
FIG. 8 is a perspective view showing the bed in a Trendelenberg position.
Figure 9:
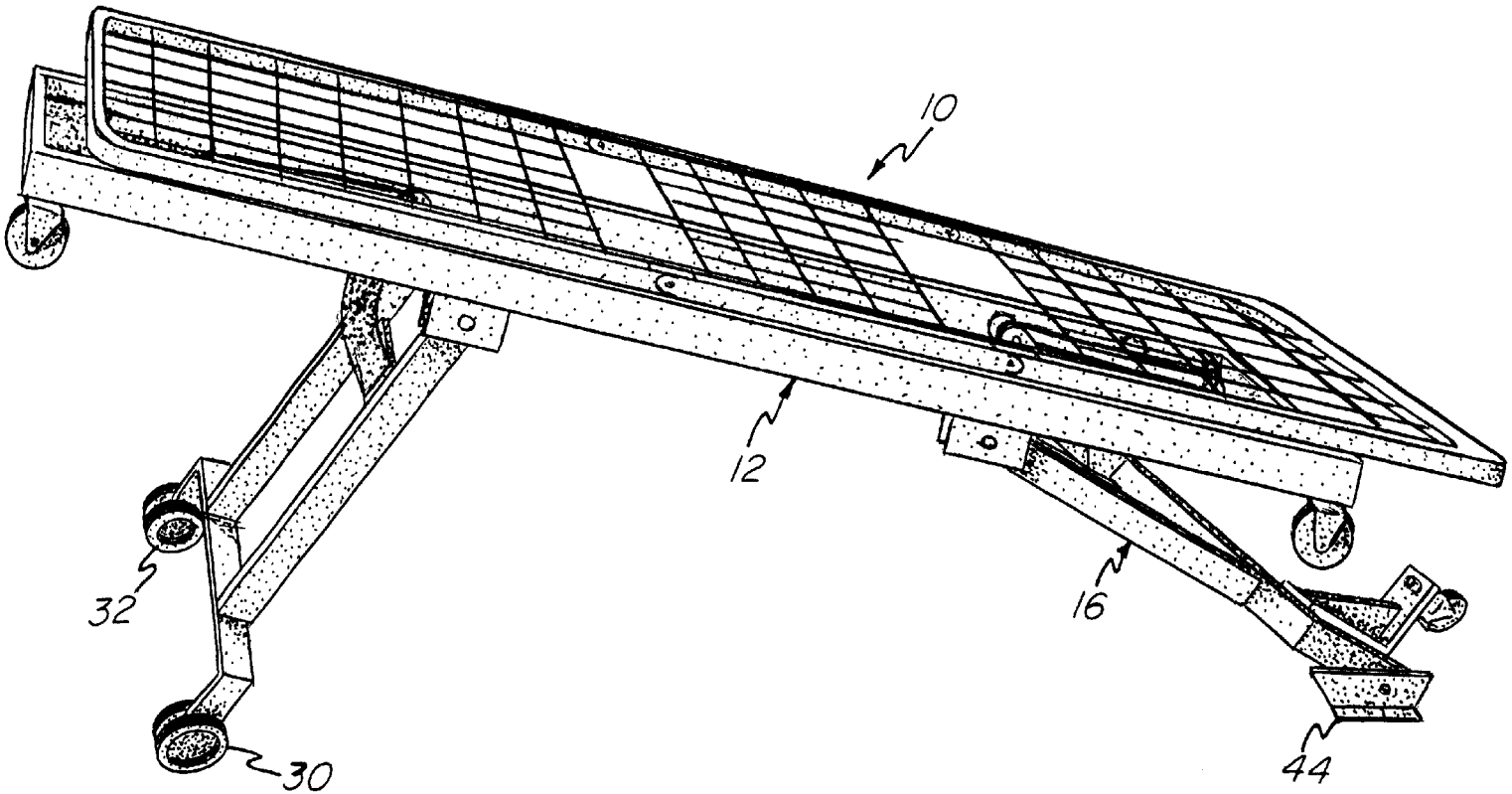
FIG. 9 is a perspective view showing the bed in a reverse Trendelenberg position.

FIG. 8 illustrates a Trendelenberg position for the bed 10, and FIG. 9 illustrates a reverse Trendelenberg position for the bed. The Trendelenberg position is achieved by actuating the first actuator 76 to position the head end support member 14 in a retracted position adjacent the frame 12, while the opposite, second actuator 92 positions the foot end support member 16 in an extended position away from the frame 12.

Similarly, the reverse Trendelenberg position is achieved by causing the second actuator 92 to retract the foot end support member 16 to a position adjacent the frame 12, and the opposite, first actuator 76 is caused to move the head end support member 14 to an extended position away from the frame 12. Both the Trendelenberg and the reverse Trendelenberg positions are determined by the controller for the bed.

Figure 10:
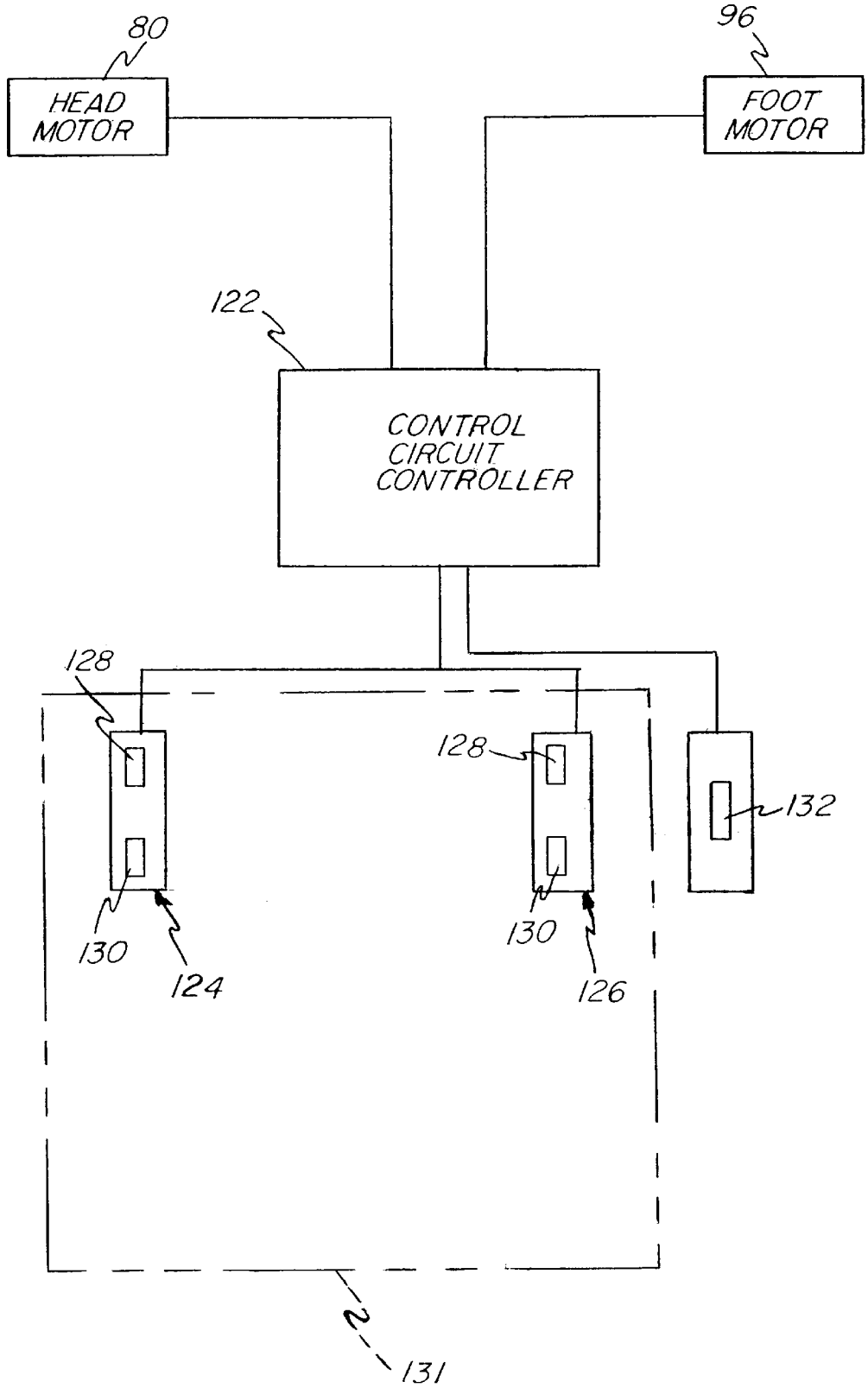
FIG. 10 is a schematic view of the control system for the bed.

Referring to FIG. 10, operation of the motors 80, 96 is controlled by controller 122 receiving operator directed inputs from one of two headboard mounted controls 124 and 126 (see also FIG. 2) for providing bed up and bed down functions. In addition, a pendent and/or bed rail mounted control panel (not shown) may be provided for controlling motors (not shown) for articulating the patient support surface 18, as described in the above-noted U.S. Pat. No. 6,076,209.

The controls 124 and 126 each include a bed up switch 128 and a bed down switch 130, which may be provided as the individual switches illustrated in FIG. 10 or may be provided as three position rocker switches (not shown) each having a central resting position and a bed up and a bed down position. It should be noted that the controls 124 and 126 are shown located on the back of a headboard 131 adjacent to the left and right sides of the headboard 131. The controls 123, 126 are located at the back of the headboard 131 in order to place them out of sight, such as adjacent to a wall when the bed is located in a room. Positioning the controls out of sight makes it less likely that the controls 124, 126 will be operated by unauthorized persons, for example, providing convenient access for a nurse but limiting access to a resident. Also, positioning a control 124, 126 on each side of the headboard 131 facilitates convenient operation of the bed up and bed down height function for the bed from either side of the bed.

It should be noted that the bed height control may be provided at alternative locations, depending on the degree of access to be offered to the resident. For example, for those residents capable of handling their own bed height adjustment, the height adjust controller could be provided as a hand held pendent device.

A tilt switch 132 is additionally provided and may be supported at any convenient location, such as on the frame of the bed, for controlling tilting movement of the bed. The tilt switch 132 is a three-position rocker switch having a central resting position and two other positions providing for tilting of the bed in two opposing directions corresponding to Trendelenberg and reverse Trendelenberg positions.

Figure 11A:
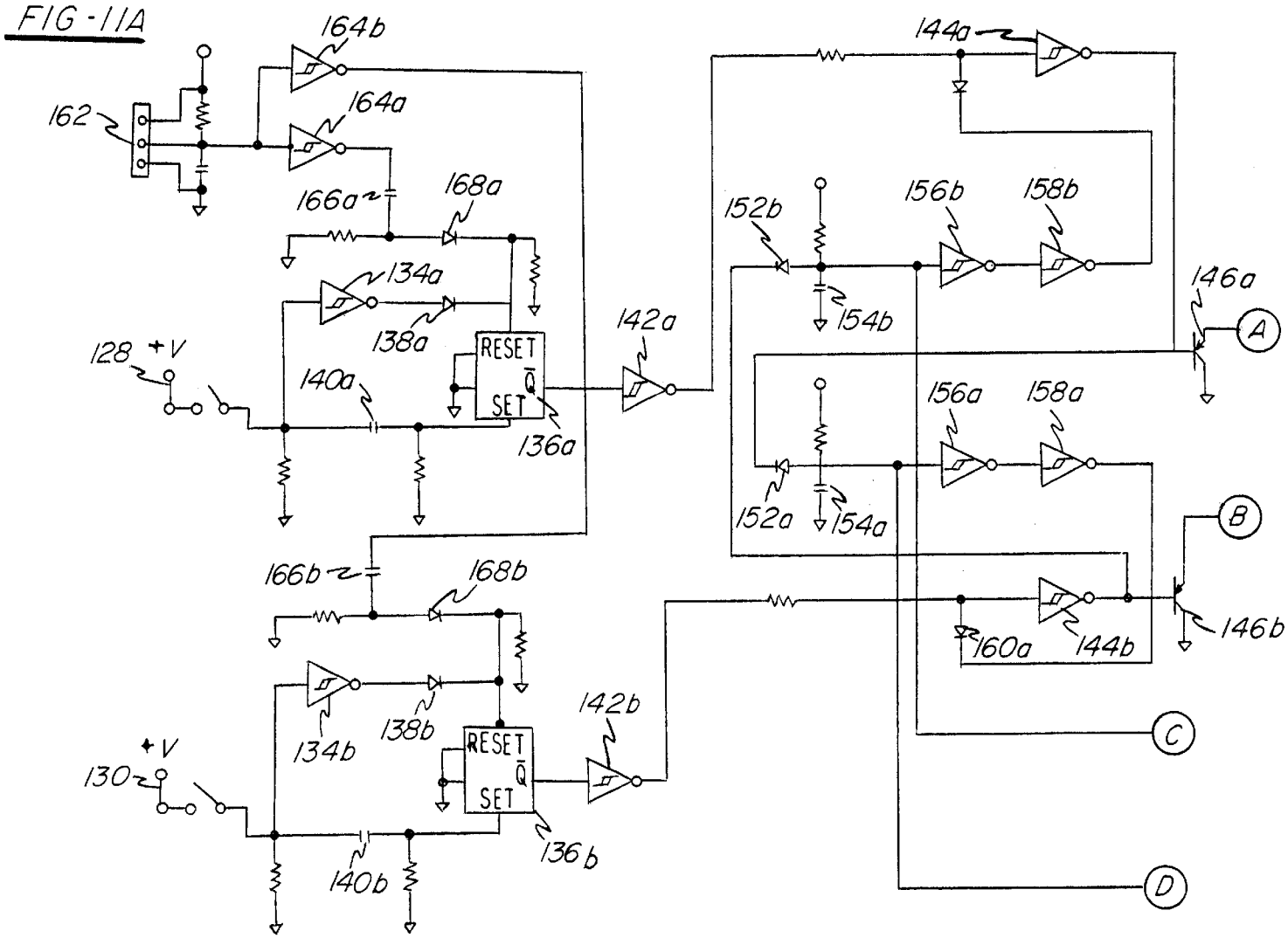
FIGS. 11A, 11B and 11C illustrate a circuit diagram for the control system of the bed.
Figure 11B:
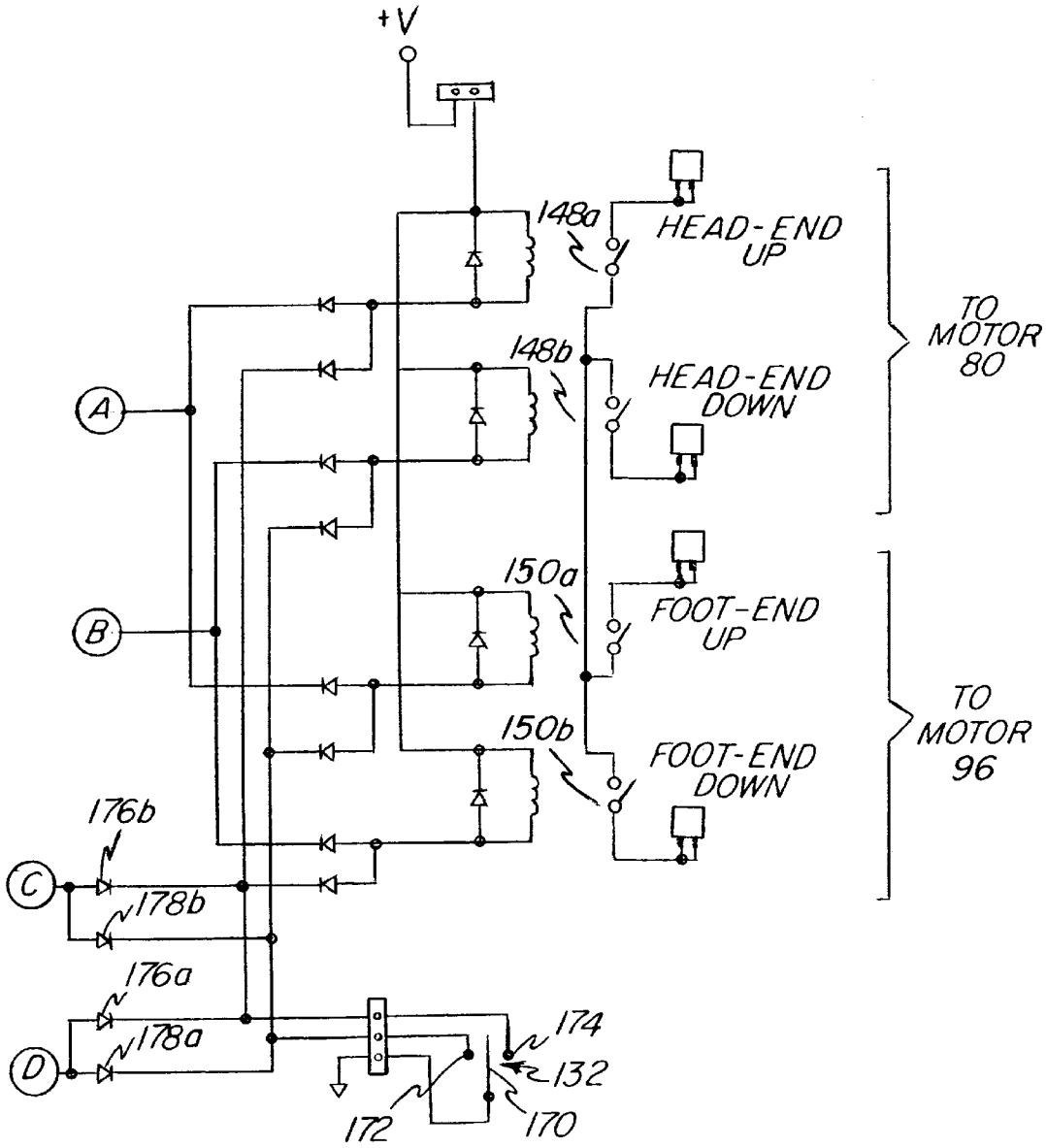

Referring further to FIGS. 11A and 11B, a control circuit for the controller 122 is illustrated for actuating the motors 80, 96 in response to inputs from the controls 124, 126. The switches 128, 130 are connected to the input pins of invertors 134*a* and 134*b* which provide inputs to identical bed up and bed down circuit elements. The bed up and bed down circuits will be described with reference to the bed up circuit elements, in which elements are identified with reference numerals having the suffix "a", it being understood that the description applies equally to the bed down circuit elements, in which elements of the bed down circuit corresponding to the bed up circuit elements are identified with the same reference numerals having the suffix "b".

In the resting state, the input to invertor 134*a* is at 0 volts, resulting in the output of the invertor 134*a* normally being at a logic high level. When the bed up switch 128 is activated, +12 v DC is applied to the input pin of the invertor 134*a,* causing the output to the invertor 134*a* to go to a logic low level. The output of the invertor 134*a* is connected to the reset pin of set-reset (SR) flip-flop 136*a* through a diode 138*a,* and the change in the output from the invertor 134*a* to a logic low level removes the reset signal from reset pin of SR flip-flop 136*a.* Simultaneously, the +12 volt signal from the switch 128 is momentarily coupled by capacitor 140*a* to the set pin of the SR flip-flop 136*a* causing the output pin of the SR flip-flop 136*a* to change logic states, causing the input to an invertor 142*a* to turn on and go to a logic low level. With the output of the SR flip-flop switch on, the capacitor 140*a* will charge to +12 v and the voltage at the set pin of SR flip-flop will return to a logic low level in approximately 100 microseconds. The output of the SR flip-flop will remain on until either the switch 128 is released, or a signal is received from one of the Hall-effect sensors 116, 118, as will be discussed in greater detail below.

With the input of the invertor 142*a* at a logic low level, the output of the invertor 142*a* provides a logic high level input to invertor 144*a,* which in turn has a logic low output. The output of the invertor 144*a* is buffered by a PNP transistor 146*a* connected to an emitter-follower circuit connected to the low side of the coils for activating the relays 148*a* and 150*a.* The relay 148*a* actuates the first motor 80 for moving the head end of the bed upwardly, and the relay 150*a* actuates the second motor 96 for moving the foot end of the bed upwardly.

As noted previously, the circuit elements associated with the bed down switch 130 operate in the same manner as the bed up circuit elements described above wherein actuation of the bed down circuit causes activation of the relays 148*b* and 150*b* to actuate the motors 80 and 96, respectively, to move the bed downwardly.

In addition, it should be noted that means are provided for ensuring that the switches 128 and 130 are used exclusively of each other, whereby the system will not respond to both a bed up and a bed down signal at the same time. In particular, the output of invertor 144*a* is additionally connected to diode 152*a* such that whenever the bed up function is activated, the diode 152*a* will discharge a capacitor 154*a* to 0 volts. The capacitor 154*a* is connected to the input pin of invertor 156*a,* such that the output of invertor 156*a* has a high logic level, resulting in the output of connected invertor 158*a* having a low logic level. The output of invertor 158*a* is connected to the input pin of the bed down circuit invertor 144*b* by diode 160*a* such that, if the bed down switch 130 is operated while the bed up function is running, the bed down function will be inhibited and the motors 80, 96 will continue to run in the bed up mode. Similarly, bed up actuation will be disabled if the bed down switch 130 is closed to actuate the bed down circuit.

As noted previously, the Hall-effect switches 116, 118 will cause movement of the bed to be terminated at upper and lower intermediate positions as the bed is moving either upwardly or downwardly into proximity to either of the Hall-effect switches 116, 118. The outputs of the Hall-effect sensors 116, 118 are connected to the control circuit at junction 162 wherein the outputs of the sensors are normally at a logic high level and will go low when triggered by the magnet 112. When a low level signal is applied to the junction 162, the signal is inverted by invertors 164*a* and 164*b* and is momentarily coupled through capacitors 166*a,* 166*b* and diodes 168*a,* 168*b,* respectively, to the reset pins of the RS flip-flops 136*a* and 136*b.* This causes both of the RS flip-flops 136*a,* 136*b* to be reset and terminates actuation of the motors 80, 96. The capacitors 166*a* and 166*b* will charge to +12 vDC in approximately 0.1 second and the reset signal will be removed from both RS flip-flops 136*a,* 136*b.* Since the set pins for the RS flip-flops 136*a,* 136*b* are at a logic low level, the outputs from the RS flip-flops 136*a,* 136*b* will not turn on in response to the reset signal being removed. The depressed switch 128, 130 must first be released, discharging the associated capacitor 140*a,* 140*b,* and upon re-actuation of the switch 128, 130 the motors 80, 96 will again be activated to vertically position the bed.

The tilt switch 132 is connected directly to the motor controlling relays 148*a,* 148*b,* 150*a,* 150*b* through diode logic to actuate an appropriate pair of relays 148*a,* 150*b* and 148*b,* 150*a* to cause the bed to tilt to a Trendelenberg or reverse Trendelenberg orientation. Accordingly, if the movable contact member 170 of the switch 132 is moved to contact 172, the relays 148*b* and 150*a* will be activated to actuate the first motor 80 to move the head end downwardly and to actuate the second motor 96 to move the foot end upwardly for Trendelenberg positioning of a patient/resident. Similarly, if the movable contact member 170 is moved to contact 174, the relays 148*a* and 150*b* will be activated to actuate the first motor 80 to move the head end upwardly and to actuate the second motor 96 to move the foot end upwardly for reverse Trendelenberg positioning of the patient/resident.

It should be noted that when the tilt switch 132 is actuated to either contact position 172, 174, the normal control logic for moving the bed vertically is inhibited by discharging the capacitors 154*a* and 154*b* to a low state through the diodes 176*a*, 178*a* or 176*b*, 178*b*. This disables the normal control through the switches 128, 130 until the tilt switch 132 is released for approximately one to two seconds, and thereby prevents the tilt control and normal vertical control from causing both up and down relays for a single motor to be on at the same time in the event that an operator depresses one of the vertical control switches 128, 130 at the same time as the tilt switch 132.

Figure 11C:
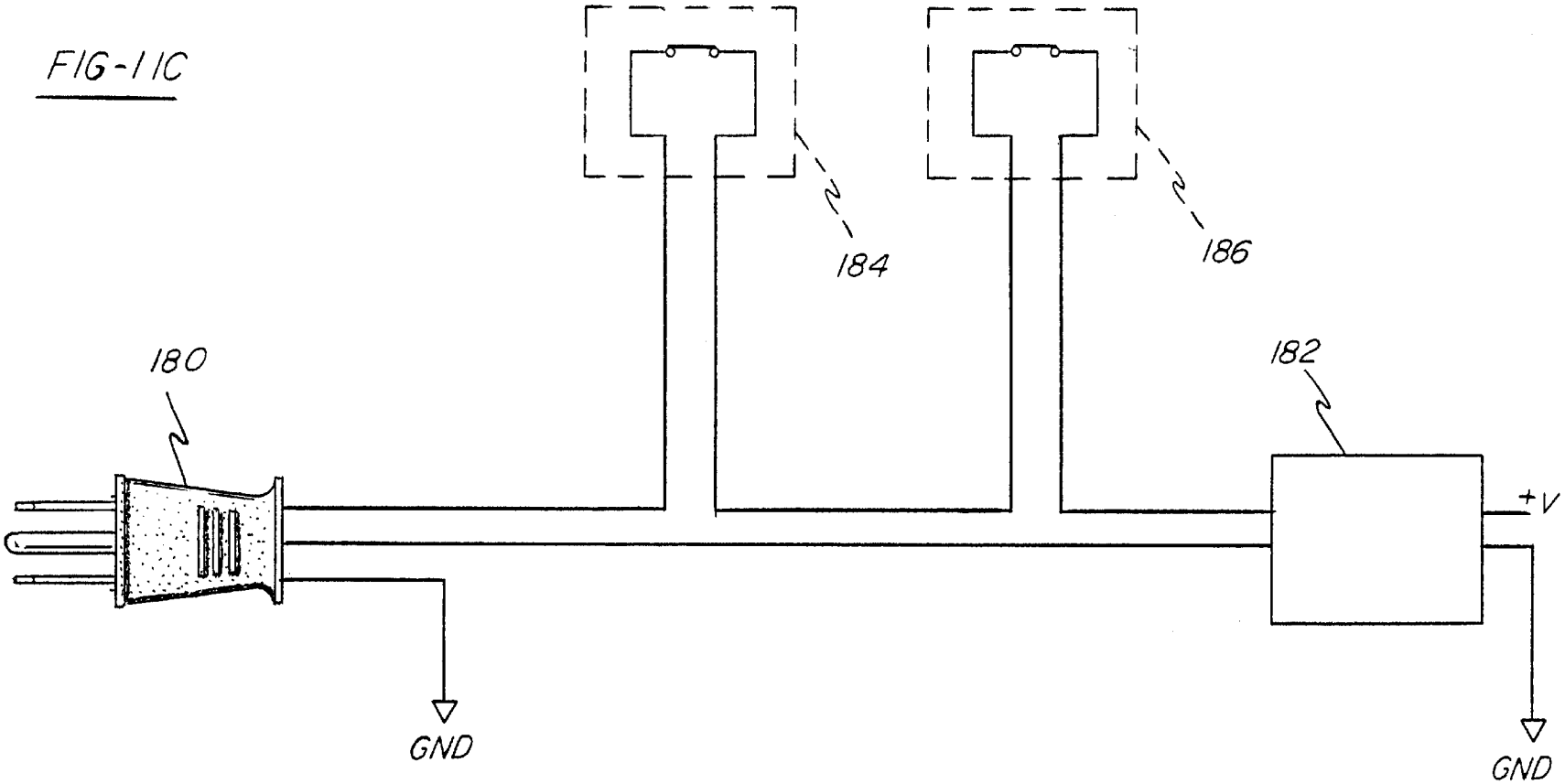

Referring to FIG. 11C, the power supply for the bed is illustrated, and in particular a safety circuit portion of the control circuit is shown for ensuring that the support members 14, 16 are not pivoted past predetermined limits relative to the main frame 12. Specifically, power is supplied via a plug 180 for plugging into a conventional 120 vAC outlet. The plug is connected to a transformer 182 of conventional design for converting 120 vAC to 12 vDC power which is connected to the control circuit at the indicated points in FIGS. 11A and 11B.

One line of the 120 vAC power is connected in series through first and second normally closed switches 184, 186 which are mounted to the main frame 12, as seen diagrammatically in FIGS. 2 and 3, respectively.

The switches 184, 186 may comprise a switch lever or other member which will be actuated by contact with the respective support members 14 and 16 in the event that either support member 14, 16 pivots past a predetermined limit or stop position. Opening of either switch 184 or 186 will cause the power to the control circuits to be cut off and thereby provide a safety feature in the event the internal stop switch in either of the actuators 76, 82 fails to properly terminate upward movement of the support members 14, 16.

From the above description, it should be apparent that the present invention provides a medical bed which provides for convenient positioning of a patient/resident, including predetermined stop positions located intermediate uppermost and lowermost stop positions for the bed, and further provides floor engaging members which provide for horizontal movement of the bed during the vertical movement. In addition, it should be noted that although particular means are disclosed for controlling the vertical movement of the bed, alternative means may be provided. For example, the Hall-effect sensors may be replaced by other types of sensors, such as position sensors for sensing the relative position between one or both support members 14, 16 and the frame 12, or sensors for sensing the distance between a portion of the bed, such as the frame, and the floor surface, as may be provided by optical or acoustic sensors. Other examples of sensors include a timer style sensor, such as for timing the actuation of the motors 80, 96, or a sensor for sensing rotational movement of the motor screw, such as a sensor in the form of an encoder, may be provided for sensing rotation of the screws driven by the motor 80, 96. Alternatively, a cam style sensor located within either or both the motors 80, 96 may be used, such as is commonly used to sense end limit positions for the motor, and may include a plurality of intermediate cam actuated sensor positions between the limit positions.

Also, means may be provided for permitting the particular location of the upper and lower intermediate positions to be adjusted to accommodate user preferences for the height of these positions, as well as additional position defining means to provide additional stop positions throughout the range of vertical movement of the bed. Further, an alternative control circuit may be provided for accomplishing the described positioning of the bed frame.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A height adjustable medical bed comprising:

a support surface for supporting a person in a supine position;

a main frame supporting the support surface defining head and foot ends for the bed;

support members for raisin and lowering the main frame relative to a floor surface;

drive means connected to the support members for actuating the support members in movement relative to the main frame whereby the support members move the main frame between a lowermost position and uppermost position;

a control system comprising operator actuated switches for controlling the drive means, including switches for actuating the main frame in vertical movement to the uppermost and the lowermost positions and to position in between the uppermost and the lowermost positions; and wherein the control system includes a sensor for sensing a predetermined intermediate vertical position of the main frame located at a predetermined vertical location between the uppermost and the lowermost positions, the sensor providing a signal to the control system corresponding to the predetermined intermediate vertical position and thereby terminating vertical movement of the main frame without operator intervention.

2. The bed of claim 1 wherein the control system causes the drive means to be deactivated at the intermediate position, and release and re-actuation of one of the switches causes the control system to reactivate the drive means to move the main frame.

3. The bed of claim 1 wherein the sensor further senses a second intermediate position of the main frame whereby the control system automatically terminates movement of the main frame at the second intermediate position.

4. The bed of claim 3 wherein the control system causes the drive means to be deactivated at the second intermediate position, and release and re-actuation of one of the switches causes the control system to reactivate the drive means to move the main frame to the uppermost position.

5. The bed of claim 3 wherein the support members include a support leg having an upper end pivotally attached to the main frame and a lower end including a frictional engaging surface and a roller engaging surface located adjacent and in fixed relation to each other at the lower end of the support leg, the functional engaging surface supporting the main frame throughout vertical movement of the main frame until the support members are located at the second intermediate position, and the roller engaging surface moving into position to support the main frame as the support member move from the second intermediate position to the uppermost position.

6. The bed of claim 3 wherein the second intermediate position is located above said predetermined vertical intermediate position and is adjacent to and spaced from the uppermost position.

7. The bed of claim 1 wherein the control system comprises a tilt switch for actuating the main frame in movement to Trendelenberg and reverse Trendelenberg positions.

8. The bed of claim 7 wherein the support members comprise a head end member and a foot end member, each of the head end and foot end members having an upper end pivotally mounted to the main frame and a lower end engaging a floor surface.

9. The bed of claim 8 wherein the drive means includes a first motor for driving the head end member in pivotal movement relative to the main frame, and a second motor for driving the foot end member in pivotal movement relative to the main frame, the control system operating to control simultaneous actuation of the motors to move the main frame to operator selected vertical and tilted positions.

10. The bed of claim 1 further including a headboard mounted to said head end of said main frame and having opposing sides, said operator actuated switches comprising at least one switch located on a side of said headboard facing away from said foot end of said main frame.

11. The bed of claim 10 wherein said operator actuated switches comprise a pair of switches mounted adjacent to lateral sides of said headboard on said side of said headboard facing away from said foot end of said main frame.

12. A height adjustable medical bed comprising:

a support surface for supporting a person in a supine position;

a main frame supporting the support surface defining head and foot ends for the bed;

support members for raisin and lowering the main frame relative to a floor surface, the support members including a head end member and a foot end member;

the support members being supported for movement relative to the main frame whereby the support members move the main frame in vertical movement between a lowermost position and an uppermost position;

the head end member and foot end member each including an upper end pivotally attached the main frame, and the support members being actuated in pivotal movement relative to the main frame;

the head end member including a lower end, and roller means attached to the lower end to enable the lower end to engage a floor surface and roll relative the floor surface during vertical movement of the main frame;

the foot end member including a lower end, and a frictional engaging surface at the lower end of the foot end member for en aging the floor surface at a substantially stationary position during vertical movement of the main frame;

the lower end of the foot end member further including a roller engaging surface, the roller engaging surface moving into rolling engagement with the floor surface and the frictional engaging surface moving out of engagement with the floor surface as the main frame approaches the uppermost position; and wherein upward movement of the main frame is automatically terminated at an intermediate position during upward movement of the main frame and prior to reaching the uppermost position, the intermediate position being defined prior to the roller engaging surface moving into rolling engagement with the floor surface.

13. The bed of claim 12 wherein the roller engaging surface is located adjacent and in fixed relation to the frictional engaging surface, and the roller engaging surface and frictional engaging surface follow an arcuate path during movement of the foot end member relative to the main frame.

14. The bed of claim 12 including a control system comprising operator actuated switches for controlling a drive means for actuating the support members in pivotal movement, and a sensor for sensing an intermediate position of the main frame adjacent to and spaced above the lowermost position whereby the control system automatically terminates downward movement of the main frame at the intermediate position.

15. A height adjustable medical bed comprising:

a support surface for supporting a person in a supine position;

a main frame supporting the support surface defining head and foot ends for the bed;

support members for raisin and lowering the main frame relative to a floor surface, the support members including a head end member and a foot end member;

drive means connected to the support members for actuating the support members in movement relative to the main frame whereby the support members move the main frame in vertical movement between a lowermost position and an uppermost position;

the head end member and foot end member each including an upper end pivotally attached the main frame wherein the drive means actuates the support members in pivotal movement relative to the main frame;

the head end member including a lower end, and roller means attached to the lower end to enable the lower end to engage a floor surface and roll relative the floor surface during vertical movement of the main frame;

the foot end member including a lower end, and a frictional engaging surface at the lower end of the foot end member for en aging the floor surface at a substantially stationary position during vertical movement of the am frame;

a control system comprising operator actuated switches for controlling the drive means in upward and downward movement to the lowermost and the uppermost positions;

a sensor for sensing a lower intermediate position of the main frame adjacent to and spaced above the lowermost position on whereby the control system automatically terminates movement of the main frame at the lower intermediate position without operator intervention;

the sensor additionally sensing an upper intermediate position of the main frame adjacent to and spaced below the uppermost position whereby the control system automatically terminates movement of the main frame at the intermediate position without operator intervention.

16. The bed of claim 15 wherein the lower end of the foot end member further includes a roller engaging surface the upper intermediate position being defined prior to the roller engaging surface moving into rolling engagement with the floor surface, the roller engaging surface moving into rolling engagement with the floor surface and the frictional engaging surface moving out of engagement with the floor surface as the main frame moves from the upper intermediate position and approaches the uppermost position.

* * * * *

UNITED STATES PATENT AND TRADEMARK OFFICE

CERTIFICATE OF CORRECTION

PATENT NO. : 6,601,251 B2
DATED : August 5, 2003
INVENTOR(S) : Gerald S. Paul

It is certified that error appears in the above-identified patent and that said Letters Patent is hereby corrected as shown below:

Column 10,
Line 19, “for raisin and” should read -- for raising and --;
Line 29, “to position in” should read -- to positions in --;
Line 59, “the functional engaging” should read -- the frictional engaging --;
Line 64, “support member move” should read -- support members move; --;

Column 11,
Line 32, “for raisin and” should read -- for raising and --;
Line 51, “for en aging the” should read -- for engaging the --;

Column 12,
Line 19, “for raisin and” should read -- for raising and --;
Line 37, “for en aging the” should read -- for engaging the --;
Line 39, “the am frame” should read -- the main frame --;
Line 47, “position on whereby” should read -- position whereby --;
Line 58, “engaging surface the” should read -- engaging surface, the --.

Signed and Sealed this

Twenty-fourth Day of February, 2004

JON W. DUDAS
*Acting Director of the United States Patent and Trademark Office*